US012617010B2

(12) United States Patent
Caprotti et al.

(10) Patent No.: US 12,617,010 B2
(45) Date of Patent: May 5, 2026

(54) BENDING METHOD AND BENDING MACHINE FOR THE EXECUTION OF A BENDING METHOD

(71) Applicant: BLM S.P.A., Cantu' (IT)

(72) Inventors: Fabrizio Caprotti, Cantu' (IT); Andrea Baraldo, Cantu' (IT); Angelo Ponti, Cantu' (IT); Luca Bascetta, Milan (IT); Gianni Ferretti, Milan (IT)

(73) Assignee: BLM S.P.A., Cantu' (CO) (IT)

( * ) Notice: Subject to any disclaimer, the term of this patent is extended or adjusted under 35 U.S.C. 154(b) by 377 days.

(21) Appl. No.: 18/269,058

(22) PCT Filed: Dec. 23, 2021

(86) PCT No.: PCT/IB2021/062268

§ 371 (c)(1),
(2) Date: Jun. 22, 2023

(87) PCT Pub. No.: WO2022/137201

PCT Pub. Date: Jun. 30, 2022

(65) Prior Publication Data

US 2024/0116096 A1 Apr. 11, 2024

(30) Foreign Application Priority Data

Dec. 23, 2020 (IT) ..... 102020000032258

(51) Int. Cl.
*B21D 7/02* (2006.01)
*B21D 7/024* (2006.01)

(52) U.S. Cl.
CPC ..... *B21D 7/024* (2013.01)

(58) Field of Classification Search
CPC ..... G05B 2219/36203; G05B 13/044; B21D 7/024; B21D 7/12; B21D 43/006; B21F 1/006
See application file for complete search history.

(56) References Cited

U.S. PATENT DOCUMENTS 5,235,909 A * 8/1993 Gerstenberger ..... B41F 13/085 101/216
2011/0192204 A1 8/2011 Steinhilber et al.
2015/0024343 A1* 1/2015 Mayer ..... A61B 17/88 606/86 R

FOREIGN PATENT DOCUMENTS

CN 102189198 A 9/2011
DE 102014206622 10/2015
TW 202021684 A 6/2020

OTHER PUBLICATIONS

International Search Report and Written Opinion in corresponding International Patent Application No. PCT/IB2021/062268, mailed Mar. 16, 2022 (13 pages).

(Continued)

*Primary Examiner* — Christopher W Carter
(74) *Attorney, Agent, or Firm* — Leason Ellis LLP

(57) ABSTRACT

A method of bending a metallic article comprising at least the following steps is described: a) executing a relative movement between a bending head having at least one bending group and the metallic article, and b) bending the metallic article by means of an activation of the bending group. During step b), at least a first actuation device actuates the bending group according to a respective motion profile and during the step a), at least a second actuation device actuates a relative movement between the bending head and the metallic article according to a respective motion profile. The method also comprises a step of preparing, during which a respective initial motion profile of the first actuation device and/or of the second actuation device is modified for obtaining the respective motion profile in function of a first parameter and of a second parameter.

18 Claims, 4 Drawing Sheets

(56) References Cited

OTHER PUBLICATIONS

WAFIOS AG, "Automatic Optimization of Bent Parts of Quality and Performance Enhancement by Calculating the Ideal Tool Motion Profiles", (2017) an English Translation attached.
WAFIOS Press Release (Apr. 2016), an English Translation attached.
Wikipedia, "Harmonic Oscillator", Jul. 2024, an English Translation attached.
Taiwanese Search Report in TW Application No. 110148227, mailed Jul. 28, 2025, an English Translation attached herewith (2 pages).

* cited by examiner

BENDING METHOD AND BENDING MACHINE FOR THE EXECUTION OF A BENDING METHOD

CROSS-REFERENCE TO RELATED APPLICATIONS

This Patent Application is a U.S. National Phase Application under 35 U.S.C. § 371 of International Patent Application No. PCT/IB2021/062268, filed on Dec. 23, 2021, which claims priority from Italian Patent Application No. 102020000032258, filed on Dec. 23, 2020, all of which are incorporated by reference, as if expressly set forth in their respective entireties.

TECHNICAL FIELD

The present invention relates to a method of bending a metallic article, in particular an elongated metallic article, even more in particular a metal wire or a metal tube, for obtaining a determined bended article. In particular, the present invention relates to a method of bending a metallic article which enables a reduction in the oscillations of the metallic article which may develop during the method itself.

Advantageously, the present invention also relates to a bending machine, in particular a wire bending machine or tube bending machine, for the bending of metallic articles.

BACKGROUND ART

Bending machines are known for bending metal wires or for bending metal tubes.

Such machines are configured to execute a series of bendings for obtaining a bended wire or a bended tube, respectively.

It is also known that these machines comprise at least one bending head having one or more bending groups for carrying out the bendings and an activation apparatus for carrying out relative movements between the bending head and the wire or the tube.

The activation apparatus allows to obtain a relative positioning between the wire or the tube and at least one of the bending groups so that said bending group can carry out a respective bending.

It is known that the activation apparatus can be configured to move and/or rotate the bending head and/or advance the wire or tube along an advancement path.

A typical bending group comprises a turret having one or more engagement elements, each configured to contact the wire or the tube and an actuator coupled to the turret and configured to rotate and translate the turret around and along an axis for bending the wire or the tube.

During the bending, the respective actuator executes a respective determined motion profile so that at least one engagement element bends a portion of the wire or of the tube relative to another portion of the same wire or tube.

Typically each wire or tube is subjected to a series of bendings for obtaining the respective desired bended wire or the respective desired bended tube.

It is also known that for obtaining each bending the actuators must be controlled according to respective motion profiles and a respective sequence of motion profiles must also be applied in combination with modifications of the relative position between the bending head and the wire or the tube.

It has been observed that oscillations of the wire or of the tube may develop during the method which can sometimes result in unwanted deformations of the wire or tube and/or in the collision of the wire or of the tube with parts of the bending machine.

In order to avoid these problems, an operator must manually modify the specific bending method consisting of steps of bending and steps of modification of the relative position between the bending head and the wire or the tube. On the one hand, such modifications require a significant amount of time, and on the other hand, the modifications and their success rely on the experience and expertise of the specific operator.

Furthermore, it should be considered that the application of such modifications requires not only a high level of experience of the operator, but also a high basic qualification. These aspects can be problematic in countries where there is a shortage of skilled workers. In addition, a drawback may develop in contexts in which there is a high turnover of operators.

Furthermore, US-A-2011192204 proposes to reduce the oscillations thanks to the generation of compensation movements.

In alternative, DE-A-102014206622 describes the use of simulations, which require significant computational resources, for optimizing the bending of articles to be bend.

There is therefore a need in the industry for a further improvement of the methods of bending and/or of the bending machines which will allow to solve at least one of the known drawbacks.

In particular, there is a need in the industry for a method of bending and/or for a bending machine that allows a reduction in the oscillations of the wire or of the tube in an automated way.

DISCLOSURE OF INVENTION

The aforesaid aims are achieved by the present invention, since it relates to a method of bending a metallic article as defined in the independent claim. Alternative preferred embodiments are protected in the respective dependent claims.

The aforesaid aims are also achieved by the present invention, since it relates to a machine according to claim 15.

BRIEF DESCRIPTION OF THE DRAWINGS

Further features and advantages of the present invention will become apparent from the detailed description that follows, provided by way of non-limiting example with reference to the accompanying drawings, wherein.

BEST MODE FOR CARRYING OUT THE INVENTION

Figure 1:
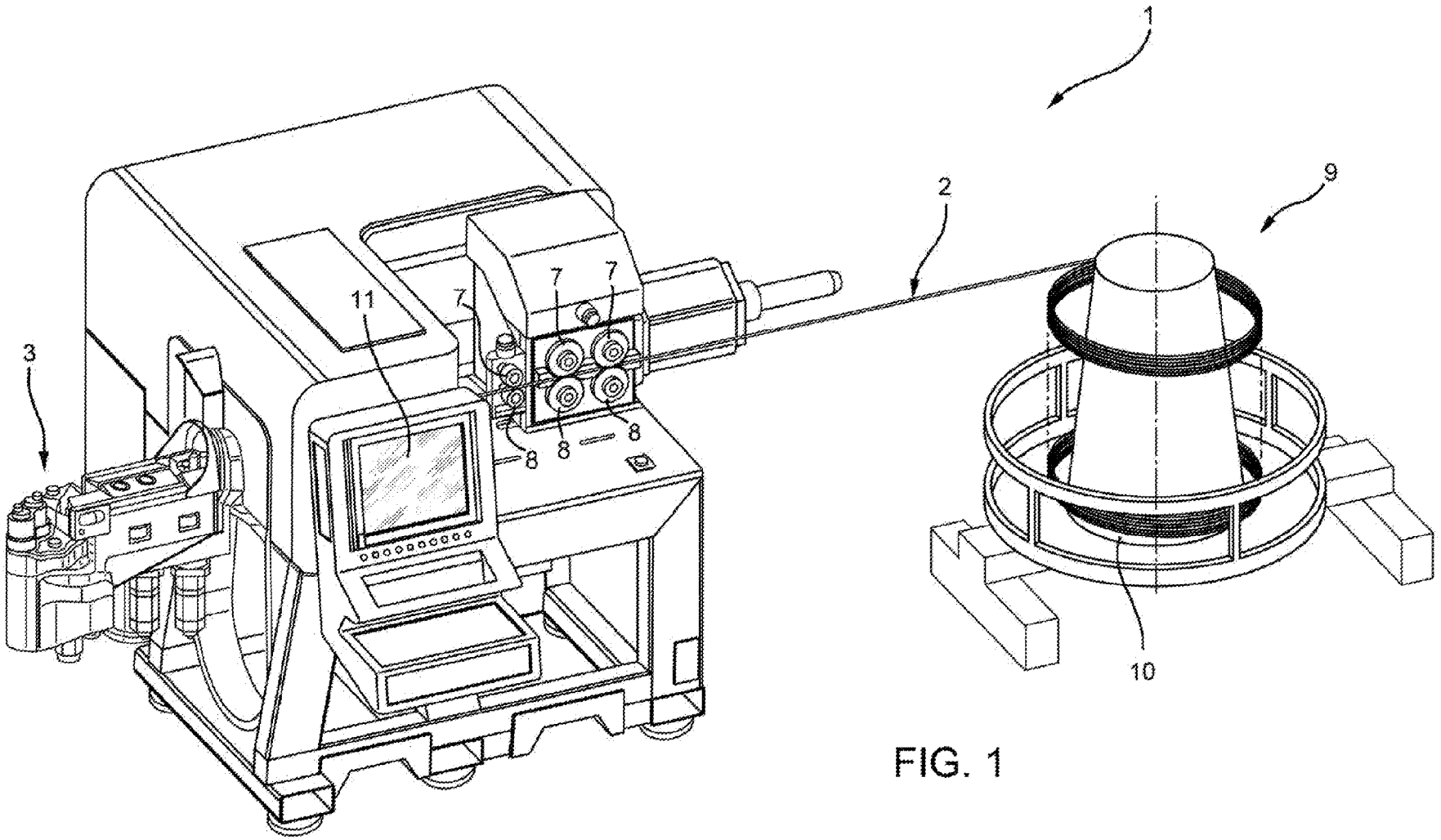
FIG. 1 schematically and partially shows a bending machine, with parts removed for clarity.

In FIG. 1, 1 denotes, as a whole, an (automatic) bending machine for the bending of metallic articles, in particular elongated metallic articles (along an axis), even more in particular metal wires 2 or metal tubes.

According to some non-limiting embodiments, the metallic articles may have circular, oval, rectangular, square, elliptical or any other shaped cross-sections.

According to some non-limiting embodiments, the metallic articles may be hollow or solid.

According to some non-limiting embodiments, the metallic article comprises at least one metallic material. According to some non-limiting variations, the metallic article could also comprise at least one non-metallic material such as for example a composite material or a plastic material.

Reference is made hereinafter without any limiting purpose to the example of the bending of metal wires 2.

However, the following description also applies to the bending of other metallic articles such as for example metal tubes.

In addition, a bending machine 1 for the bending of metal wires 2 is described in detail below without any limiting intent. However, the following description may also apply to bending machines 1 for the bending of metallic articles such as for example metal tubes.

Figure 2:
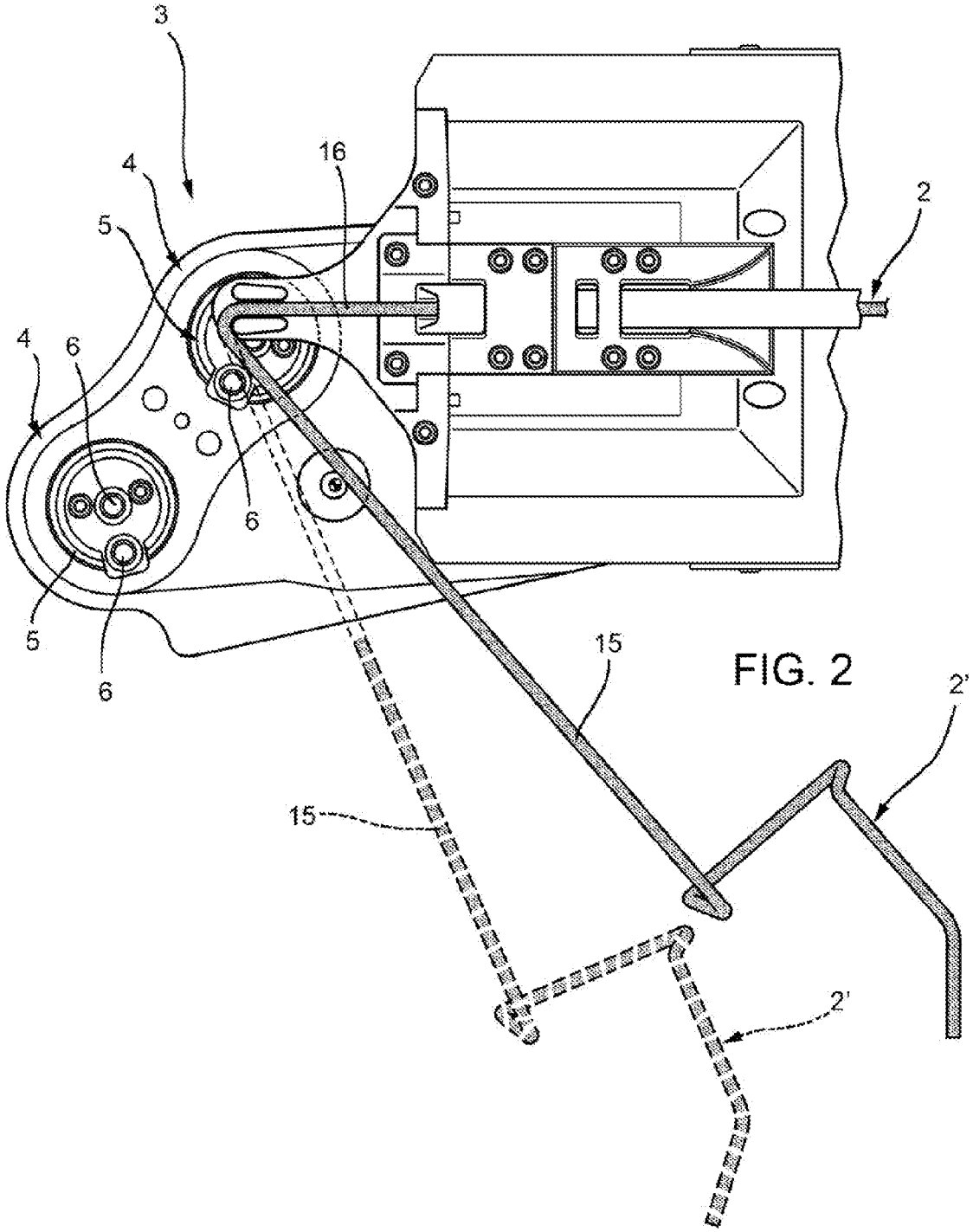
FIG. 2 shows an enlarged and isometric view of a detail of the bending machine of FIG. 1.

With particular reference to FIGS. 1 and 2, the bending machine 1 comprises at least:

- a control unit configured to control the operation of the bending machine 1 itself;
- a bending head 3, in particular operatively connected to the control unit and, configured to bend the wires 2, in particular at a bending station; and
- an activation apparatus, in particular operatively connected to the control unit, and configured to control and/or execute a relative movement between the bending head 3 and the wire 2.

In greater detail, the bending head 3 comprises one or more bending groups 4, in the specific case shown two, each bending group 4 being configured to selectively bend the wire 2. In other words, each bending group 4 is configured to execute bending steps for bending the wire 2.

In further detail, each bending group 4 may comprise at least:

- a respective turret 5, in particular being movably inserted into a respective housing seat of the bending head 3;
- one or more engagement elements 6 integral with the respective turret 5; and
- a first actuation device (known per se and not shown), in particular being operatively connected to the control unit and coupled to the respective turret 5 and configured to actuate an angular movement and/or a translation of the turret 5 around or along a respective axis, respectively.

Furthermore, the control unit is configured to control each first actuation device so as to determine the bending operations by means of the angular movement and/or the translation of the turret 5 and consequently the relative displacements of the engagement elements 6.

In this specific case, each first actuation device comprises at least one (electric) motor to determine and/or actuate the angular movement of the respective turret 5 and/or a linear actuator, for example a pneumatic actuator, to determine the translation of the respective turret 5.

In greater detail, the activation apparatus may be configured to advance the wire 2, in particular along an advancement path towards the bending station, and/or to move and/or to rotate the bending head 3, in particular around at least three axes.

In further detail, the activation apparatus may be provided with a plurality of second actuation devices, each of which is configured to determine the advancement of the wire 2 along the advancement path and/or the movement and/or the rotation of the bending head 3.

Preferably, a first plurality of the second actuation devices are configured to at least partially determine the movement and/or the rotation of the bending head 3.

Even more preferably, a second plurality of the second actuation devices may be configured to at least partially determine the advancement of the wire 2.

According to the shown non-limiting embodiment, the activation apparatus comprises a first group of advancement wheels 7 arranged one after the other and a second group of advancement wheels 8 arranged one after the other. In particular, each advancement wheel 7 faces a respective advancement wheel 8 so that the advancement wheels 7 and the advancement wheels 8 act on opposite sides of the wire 2.

In particular, the first group and the second group are arranged upstream of the bending head 3 along the advancement path.

In more detail, the advancement wheels 7 and the advancement wheels 8 are coupled to one or more second actuation devices and are configured to advance the wire 2 in cooperation between them along at least a portion of the advancement path.

Further, the bending machine 1, in particular the bending head 3, may comprise a cutting unit configured to cut the wire 2.

With particular reference to FIG. 1, the bending machine 1 may further comprise a storage device 9 containing the (not bended) wire 2. In particular, the activation apparatus is configured to advance the wire 2 from the storage device 9 towards the bending head 3 and/or the bending station.

In greater detail, the storage device 9 is configured to contain the wire 2 in the form of a roll.

In further detail, the storage device 9 comprises a support 10 carrying the wire 2 in the form of a roll, in particular the support 10 is designed to allow the unwinding of the wire 2 arranged in the form of a roll.

With particular reference to FIG. 1, the bending machine 1 may further comprise a human-machine interface 11 configured to allow an operator to transmit instructions to the bending machine 1, in particular to the control unit, and/or to receive information from the bending machine 1.

In use, the bending machine 1 bends the wire 2 for obtaining a (determined) bended wire 2'.

The method of bending comprises at least the following steps:

a) executing a relative movement between the bending head 3 and the wire 2; and b) bending the wire 2.

In addition, the method may also comprise one or more steps of repeating, during which the step a) and the step b) are repeated. In particular, the execution of the steps of repeating allows to obtain a sequence of steps a) and b) to obtain the desired bended wire 2'.

Preferably, the method also comprises at least one step of cutting, during which the wire 2 is cut. In particular, the step of cutting may be executed before or after step and/or steps a) and b).

In greater detail, during the execution of step a) at least one of the bending groups 4 is placed relative to the wire 2 so that at least one of the engagement elements 6 is placed adjacent to and/or in contact with the wire 2. Subsequently, during step b) and as explained in detail below the respective engagement element 6 is moved to obtain a respective bending of the wire 2.

More specifically, during each step b) by actuating the respective bending group 4, in particular the respective turret 5, a first (free) portion 15 of the wire 2 is bended relative to a second portion 16 of the wire 2 (see FIG. 2), for example this second portion 16 being held stationary during the execution of the respective step b). In particular, during each step b) an angle defined between the first portion 15 and the second portion 16 is obtained. Even more particularly, the defined angles may vary between one step b) and the next one (and are determined by the shape of the desired bended wire 2').

In further detail, during step a) at least one of the second actuation devices actuates the relative movement between the bending head 3 and the wire 2 according to a respective motion profile.

According to some non-limiting embodiments, during step a) several second actuation devices can also be actuated to actuate the relative movement between the bending head 3 and the wire 2, each second actuation device being actuated according to a respective motion profile.

For example, one or more of the second actuation devices, in particular the first plurality of second actuation devices, could move and/or rotate the bending head 3.

Alternatively and/or additionally, one or more of the second actuation devices, in particular the second plurality of second actuation devices, could advance the wire 2.

Furthermore, during step b) at least one of the first actuation devices, in particular the respective motor, actuates the respective bending group 4, in particular the respective turret 5, according to a respective motion profile for carrying out the respective bending of the wire 2.

More specifically, each motion profile (of a first actuation device or of a second actuation device) describes the time course of a control parameter of the respective first or second actuation device in function of the time. In particular, each motion profile defines at least acceleration and deceleration steps.

Figure 5:
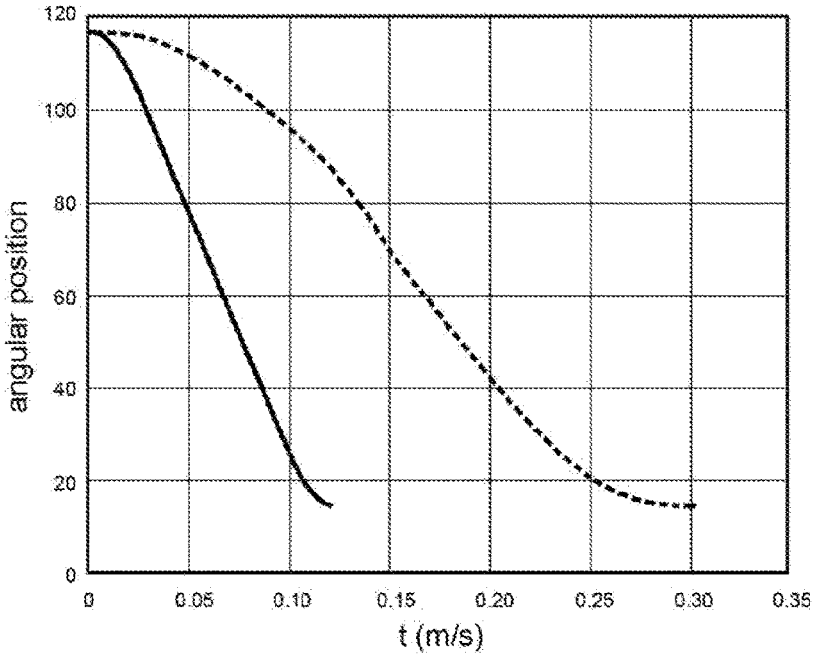
FIG. 5 shows an initial motion profile and a modified motion profile according to the present invention.

For example and as schematically indicated in FIG. 5, the motion profile (see the dashed curve) of a respective motor of a respective first actuation device can describe an angular position of the motor in function of the time. Accordingly, in this case, the motion profile describes an angular position of the respective turret 5 and/or of the respective engagement element 6 in function of the time.

It should be noted that during steps b) the respective motion profile which is actuated by the respective first actuation device may vary from the others, in particular for obtaining the respective desired angle between the first portion 15 and the second portion 16.

Preferably, during steps a) and b), the control unit controls the respective motion profiles of the first actuation devices and of the second actuation devices.

As indicated in FIG. 2, during the method, in particular following a step a) and/or a step b), oscillations of the wire 2, in particular of the first portion 15, may develop.

As described below and with the particular aim of reducing the oscillations of the wire 2, in particular of the first portion 15, at least some of the motion profiles, in particular those describing the actuation of the first actuation devices, in particular of the respective motor (and consequently of the respective turret 5), are determined in a step c) of preparing (see FIG. 6).

In greater detail, during step c), at least one respective initial motion profile (of the first actuation device and/or of the second actuation device), see for example the solid curve in FIG. 5, is modified to obtain the respective motion profile (the dashed curve in FIG. 5) in function of a first parameter a and of a second parameter b, wherein: the first parameter a depends on an oscillation frequency co of a damped harmonic oscillator which models and/or describes the oscillations of the metal wire 2 resulting from the application of the respective motion profile of the respective first actuation device or of the respective second actuation device; and the second parameter b depends on a damping of the oscillation of the damped harmonic oscillator.

Figure 3:
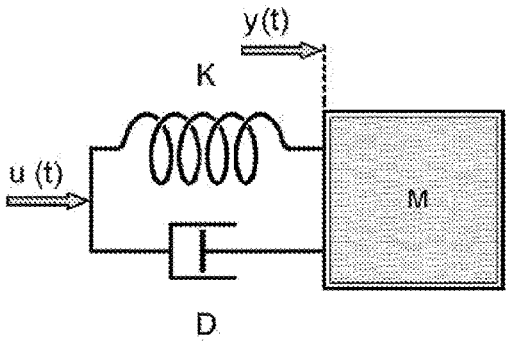
FIG. 3 schematically shows a model of a damped harmonic oscillator.

With particular reference to FIG. 3, the damped harmonic oscillator allows to determine and/or describe the oscillations y(t) of the wire 2 caused by the application of the respective motion profile u(t), in particular of the first portion 15, following the execution of the relative step a) or b).

In more detail, the harmonic oscillator is described by means of a respective mass M, a spring having spring constant K and a damper having a damping constant D.

For example in the case of step b), the applied model provides that, once the respective bending group 4, in particular the respective turret 5, even more particularly, the respective bending element 6, loses contact with the wire 2, the oscillations y(t) of the wire 2, in particular of the first portion 15, are equivalent to the free movement of the mass M in the mass-spring-damper system which is generated by moving the mass M away from its equilibrium position.

In further detail, a transfer function G(s)=Y(s)/U(s) in the Laplace domain links the oscillations y(t) to the motion profile u(t) (with Y(s) corresponding to the oscillations y(t) in the Laplace domain and with U(s) corresponding to the motion profile u(t) in the Laplace domain), wherein:

$$G(s)=Y(s)/U(s)=((2*\xi*s/\omega)+1)/((s^2/\omega^2)+(2*\xi*s/\omega)+1),$$

where s is a Laplace variable (i.e. a complex variable).

Furthermore, the oscillation frequency ω is proportional to √(K/M) and the damping ξ is proportional to:

$$D/(2*\sqrt{(M*K)}).$$

However, the values of the mass M, of the spring constant K and of the damping constant D are difficult to determine from the geometry and from the mechanical properties of the wire 2, in particular of the first portion 15, and from the characteristics connected to the material of the wire 2.

Preferably, the first parameter a is proportional, in particular equal, to the inverse of the square of the oscillation frequency ω; and the second parameter b is proportional to the damping ξ and additionally is also proportional to the inverse of the oscillation frequency ω.

Consequently: $a=1/\omega^2$ and $b=(2*\xi)/\omega$.

According to these definitions of the first parameter a and of the second parameter b, one obtains that the transfer function G(s) in the Laplace domain of the damped harmonic oscillator that links the motion profile u(t) to the oscillations y(t) is: $G(s)=(b*s+1)/(a*s^2+b*s+1)$.

It should be noted that the first parameter a and the second parameter b may vary during each step a) and/or each step b). In other words, the mass M, the spring constant K and the damping coefficient D are not constant, but may vary between each step a) and/or each step b).

Preferably, during step c) the first parameter a and the second parameter b are read from a memory 17 (see FIG. 6), in particular the memory 17 being part of the bending machine 1, even more particularly the memory 17 being part of the control unit. In particular, the memory 17 contains a plurality of sets of a respective first parameter a and of a respective second parameter b, each set attributable to one or more respective steps a) and/or b).

In addition, the method may comprise a step d) of initialization, during which one or more initial motion profiles are determined (see the solid curve in FIG. 5), in particular each connected to a respective first actuation device and/or with a respective second actuation device, in function of the desired bended wire 2'.

In further detail, during step d) steps a) and b) and their sequence are also determined.

More specifically, the initial motion profiles and/or the sequence of steps a) and b) are determined, for example by the control unit, in function of the desired bended wire 2'. For example, according to some non-limiting embodiments, the initial motion profiles and/or the sequence of steps a) and steps b) can be determined, for example by the control unit, in function of the desired bended wire 2' and by means of software systems and/or by means of the human-machine interface 11. For example, software systems may be based on computer-aided design software (CAD) and/or computer-aided manufacturing software (CAM) and/or distributed computer systems for monitoring and supervision (also known as SCADA).

According to some non-limiting variants, during step d), an operator may control and/or modify the initial motion profiles and/or the sequence of steps a) and steps b), for example by means of the human-machine interface 11.

It should be noted that even if the initial motion profiles allow to obtain the determined bended wire 2', the initial motion profiles are not optimized in view of the possible oscillations y(t) of the wire 2, in particular of the first portion 15, which may occur during the method.

Figure 4:
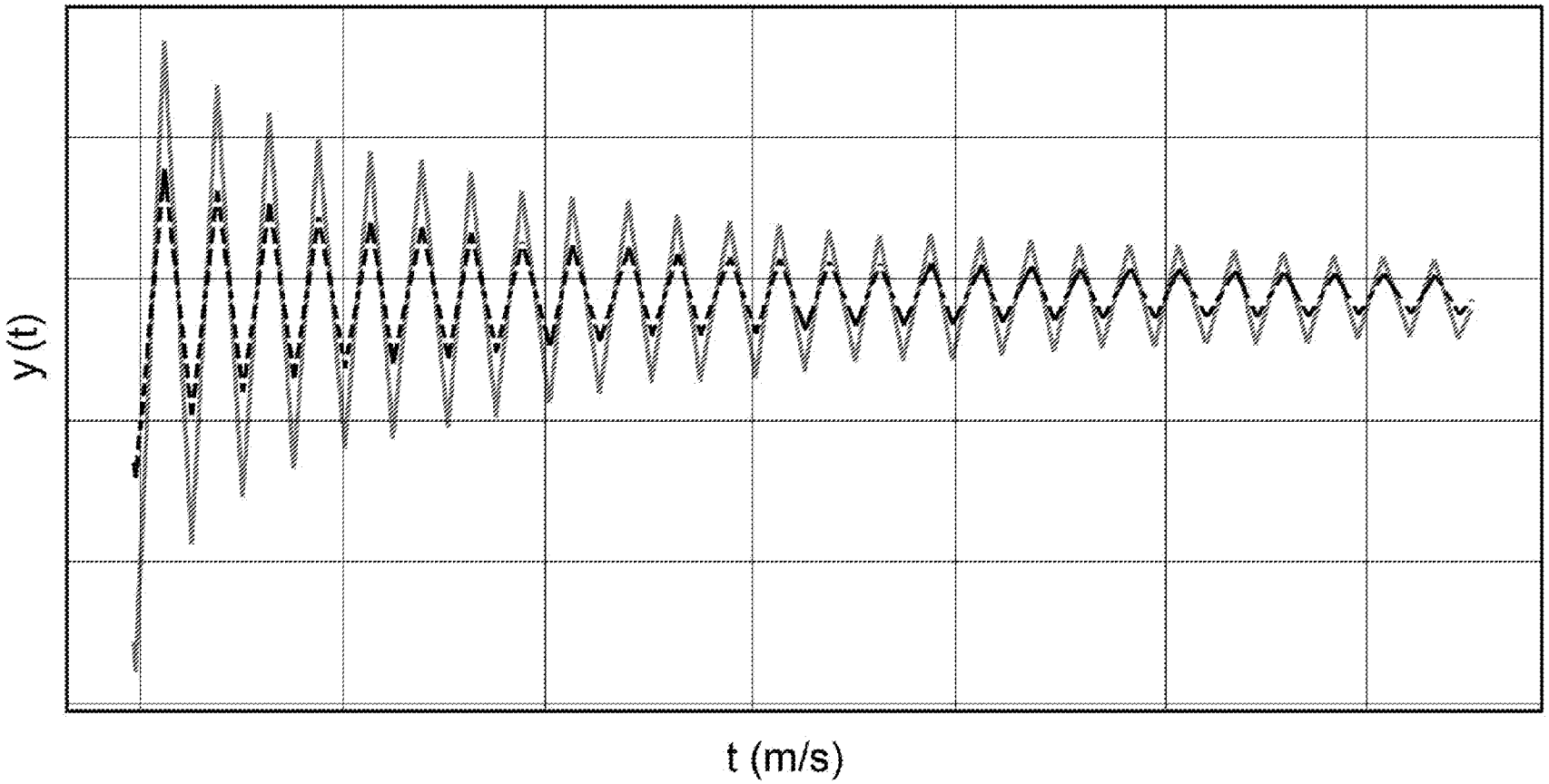
FIG. 4 shows a time course of the oscillations of a metal wire.

For example, in FIG. 4 the oscillations of the wire 2 resulting from the stress by means of an initial motion profile of a respective first actuation device, in particular of the respective motor, are shown in a continuous line and the oscillations resulting from the stress by means of the motion profile obtained by the modification of the initial motion profile are shown in a dashed line. It can be seen that the application of the motion profile allows a (significant) reduction of the oscillations y(t).

Therefore, thanks to the modification of an initial motion profile in function of the respective first parameter a and of the respective second parameter b, it is possible to reduce the oscillations connected to the respective step a) or the respective step b).

According to some non-limiting embodiments, it is not necessary to modify all the initial motion profiles, but only some of them. In particular, it has been observed that the criticalities linked to the oscillations resulting from the stresses from the second actuation devices are fewer than those linked to the oscillations resulting from the stresses from the first actuation devices.

More specifically, according to some non-limiting embodiments, only some or all of the initial motion profiles associated to the first actuation devices are modified in function of respective first parameters a and respective parameters b, and in particular the motion profiles associated to the second actuation devices are not modified.

Figure 6:
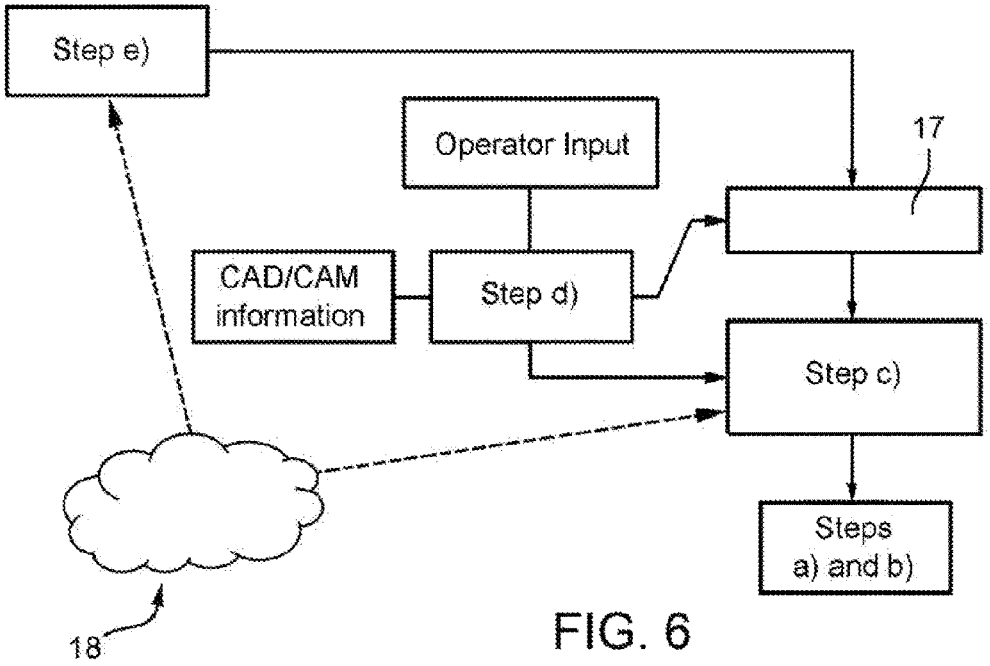
FIG. 6 schematically shows some steps of the method according to the present invention.

Preferably and with particular reference to FIG. 6, during step c), each motion profile is calculated by a calculation group 18 of the bending machine 1, in particular of the control unit, in function of the respective first parameter a and of the respective second parameter b. In particular, the calculation group 18 may be arranged locally and/or remotely.

In more detail, according to a possible embodiment, during step c) each initial motion profile (yet to be modified) is filtered, in particular by the calculation group 18, with a transfer function F(s) expressed in the Laplace domain being proportional to $(a*s^2+b*s+1)$ to determine the motion profile u(t). In particular, F(s) is a transfer function whose modulus and step diagrams in the frequency range of interest are equal to the modulus and step diagram of (a*s2+b*s+1).

Alternatively and/or additionally, during step c), an optimization sub-step is executed, in particular executed by the calculation group 18, during which the motion profile u(t) which generates the least oscillations when considering the transfer function G(s) in the Laplace domain $G(s)=((b*s+1)/(a*s^2+b*s+1))$ is determined.

In particular, during the optimization sub-step, it is started from an applied motion profile and then it is determined (by means of numerical algorithms executed by the calculation group 18) the motion profile u(t) that leads to the least oscillations.

Even more particularly, during the optimization sub-step, the calculation group 18 determines the oscillations provided by the damped harmonic oscillator model (and as described by the transfer function G(s)) in function of the applied motion profile and assigns a cost to the provided oscillations in function of the applied motion profile. Then, the calculation group 18 determines the oscillations provided by the damped harmonic oscillator model in function of a modified applied motion profile, it again determines the oscillations and the respective costs. The calculation group 18 continues these operations until the motion profile u(t) that gives rise to the least oscillations is determined.

Preferably, during the optimization sub-step, at the beginning of the optimization sub-step itself one applies a motion profile obtained from a filtering of the initial motion profile considering a transfer function F'(s) expressed in the Laplace domain being proportional to $(a*s^2+b*s+1)$. In particular, F'(s) is a transfer function whose modulus and step diagrams in the frequency range of interest are equal to the modulus and step diagram of $(a*s^2+b*s+1)$.

According to some non-limiting embodiments, for the determination of each first parameter a and of each second parameter b, a respective calibration step e) is executed.

In more detail, during step e) at least the following sub-steps are executed:

actuating the initial motion profile;

monitoring the oscillations of the wire 2, in particular of the first portion 15, following the respective sub-step of actuating; and determining the respective first parameter a and the respective second parameter b of the damped harmonic oscillator which allow to describe the monitored oscillations during the respective sub-step of monitoring.

In particular, during each sub-step of determining, the respective first parameter a and the respective second parameter b are determined, which allow for a minimum difference between the respective monitored and modelled and/or estimated oscillations.

In further detail, during the sub-step of determining, the oscillations monitored in the respective sub-step of monitoring are described and/or modelled and/or estimated according to a damped harmonic oscillator being represented by a transfer function G'(s) in the Laplace domain: $G'(s)=(b's+1)/(a's^2+b's+1)$ with a' corresponding to the first parameter to be determined and b' corresponding to the second parameter to be determined.

In particular, during the sub-step of determining, the first parameter a' and the second parameter b' which determine estimated oscillations having a minimum difference with the respective monitored oscillations define the respective first parameter a and the respective second parameter b.

More specifically, during the sub-step of determining, in particular executed by the calculation group 18 of the bending machine 1, the additional steps are executed:

i) assuming a respective value for the first parameter a' and a respective value for the second parameter b';

ii) calculating the estimated oscillations y'(t) in function of the transfer function G'(s) and the respective values for the first value a' and the second value b';

iii) comparing the estimated oscillations y'(t) with the monitored oscillations for determining an error;

iv) modifying the first parameter a' and the second parameter b' in function of the error obtained during the step iii); and v) repeating the steps ii) to iv).

In particular, steps iv) and v) are executed if the error determined in step iii) is equal to or greater than a determined threshold.

According to some non-limiting embodiments, the bending machine 1 comprises a video camera for monitoring the oscillations of the wire 2, in particular of the first portion 15.

Preferably, during the step of monitoring, the oscillations are monitored by means of the video camera.

From an examination of the characteristics of the bending machine 1 and of the method according to the present invention, the advantages it allows to be obtained are evident.

In particular, the method automatically allows a significant reduction in the oscillations of the wire 2, in particular of the first portion 15. Consequently, the risks of an undesired deformation of the wire 2 and/or the contact between the wire 2 and the bending machine 1 due to the oscillations are reduced.

A further advantage is that no operator intervention is required to reduce the oscillations.

Finally, it is clear that modifications and variations may be made to the bending machine 1 and to the method of bending described and shown here which do not depart from the scope of protection defined by the claims.

According to some embodiments not shown, the bending machine 1 comprises at least two bending heads 3.

In addition or alternatively, the activation apparatus is configured to place the wire 2 in a working position and during steps a) and steps b) the wire 2 itself is not advanced, but only the bending heads 3 move.

Additionally or alternatively, the storage device 9 may be configured to contain metallic articles from a segment, in particular metal wires or metal tubes from a segment. According to these embodiments not shown, the activation apparatus could comprise a displacement unit for the automatic loading and/or unloading of the metallic articles from a segment. Alternatively or additionally, metallic articles from a segment could be loaded and/or unloaded by hand.

The invention claimed is:

1. A method of a bending machine adapted to bend a metallic article along a longitudinal axis, for obtaining a determined bended article comprising at least the following steps:

executing a relative movement between a bending head of the bending machine, said bending head having at least one bending group, and the metallic article; and activating the at least one bending group to bend the metallic article;

wherein during the activating of the at least one bending group, at least a first actuation device actuates the at least one bending group according to a respective first motion profile for executing a respective bending of the metallic article;

wherein during the executing of the relative movement, at least a second actuation device actuates the relative movement between the bending head and the metallic article according to a respective second motion profile;

wherein the method further comprises modifying, prior to an actuation of the at least one bending group by the first actuation device and an actuation of the relative movement by the second actuation device, a first initial motion profile of the first actuation device to obtain the respective first motion profile to be used during the actuation of the at least one bending group and a second initial motion profile of the second actuation device to obtain the respective second motion profile to be used during the actuation of the relative movement;

wherein during the modifying of the first initial motion profile and the second initial motion profile, the first initial motion profile is modified in function of a first parameter and of a second parameter and the second initial motion profile is modified in function of a third parameter and a fourth parameter;

wherein the first parameter depends on a first oscillation frequency of a first damped harmonic oscillator which models the oscillations of the metallic article resulting from the application of the respective first motion profile of the respective first actuation device and the second parameter depends on a first damping of the oscillations of the first damped harmonic oscillator;

wherein the third parameter depends on a second oscillation frequency of a second damped harmonic oscillator which models the oscillations of the metallic article resulting from the application of the respective second motion profile of the respective second actuation device and the fourth parameter depends on a second damping of the oscillations of the second damped harmonic oscillator.

2. The method according to claim 1, comprising one or more steps of repeating, during which the executing of the relative movement and the activating of the at least one bending group are repeated;

wherein during the modifying of the first initial motion profile and the second initial motion profile, a plurality of respective first initial motion profiles of the first actuation device are modified in function of the respective first parameters and the respective second parameters for obtaining the respective first motion profiles, and wherein during the modifying of the first initial motion profile and the second initial motion profile, a plurality of respective second initial motion profiles of the second actuation device are modified in function of the respective third parameters and the respective fourth parameters for obtaining the respective second motion profiles.

3. The method according to claim 1, wherein during the modifying of the first initial motion profile and the second initial motion profile, the first parameter, the second parameter, the third parameter, and the fourth parameter are read from a memory.

4. The method according to claim 1, further comprising a step of initialization, during which one or more first initial motion profiles and one or more second initial motion profiles are determined in function of the desired bended metallic article.

5. The method according to claim 1, further comprising a calibration step, during which the first parameter, the second parameter, the third parameter, the fourth parameter are determined;

wherein during the calibration step the following sub-steps are executed:

actuating the first initial motion profile;

first monitoring the oscillations of the metallic article after the sub-step of actuating the first initial motion profile; and determining the first parameter and the second parameter of the damped harmonic oscillator which allow to describe first monitored oscillations during the respective sub-step of first monitoring;

actuating the second initial motion profile;

second monitoring the oscillations of the metallic article after the sub-step of actuating the second initial motion profile; and determining the third parameter and the fourth parameter of the damped harmonic oscillator which allow to describe second monitored oscillations during the respective sub-step of second monitoring.

6. The method according to claim 5, wherein during the sub-step of determining the first parameter and the second parameter, the first monitored oscillations are modelled according to a first damped harmonic oscillator being represented by means of a first transfer function G'(s) in the Laplace domain $G'(s)=(b'*s+1)/(a'*s^2+b'*s+1)$;

with a' corresponding to the first parameter to be determined and b' corresponding to the second parameter to be determined;

wherein during the sub-step of determining the third parameter and the fourth parameter, the second monitored oscillations are modelled according to a second damped harmonic oscillator being represented by means of a second transfer function G"(s) in the Laplace domain $G''(s)=(b''*s'+1)/(a''*s'^2+b''*s'+1)$;

with a" corresponding to the third parameter to be determined and b" corresponding to the fourth parameter to be determined.

7. The method according to claim 6, wherein during the sub-step of determining the first parameter and the second parameter, the following further steps are executed:

i) assuming a value for the first parameter to be determined (a') and a value for the second parameter to be determined (b');

ii) calculating estimated oscillations in function of the first transfer function (G'(s)) and the values for the first parameter to be determined (a') and the second parameter to be determined (b');

iii) comparing the estimated oscillations with the first monitored oscillations for determining an error;

iv) modifying the first parameter to be determined (a') and the second parameter to be determined (b') in function of the error obtained during the step iii); and v) repeating the steps i) to iv).

8. The method according to claim 6, wherein during the sub-step of determining third parameter and the fourth parameter, the following further steps are executed:

i) assuming a value for the third parameter to be determined and a value for the fourth parameter to be determined;

ii) calculating the estimated oscillations in function of the second transfer function and the values for the third parameter to be determined and the fourth parameter to be determined;

iii) comparing the estimated oscillations with the second monitored oscillations for determining an error;

iv) modifying the third parameter to be determined and the fourth parameter to be determined in function of the error obtained during the step iii); and v) repeating the steps i) to iv).

9. The method according to claim 5, wherein during the step of monitoring, the oscillations are monitored by means of a video camera.

10. The method according to claim 1, wherein the first parameter is proportional to the inverse of the square of the oscillation frequency and the second parameter is proportional to the damping and additionally is also proportional to the inverse of the oscillation frequency; and wherein the third parameter is proportional to the inverse of the square of the respective second oscillation frequency and the fourth parameter is proportional to the second damping and additionally is also proportional to the inverse of the second oscillation frequency.

11. The method according to claim 1, wherein the first damped harmonic oscillator is described by means of a first mass M, a first spring constant K and a first damping factor D;

wherein the first oscillation frequency is proportional to $\sqrt{(K/M)}$; and wherein the first damping is proportional to $D/(2*\sqrt{(M*K)})$;

wherein the second damped harmonic oscillator is described by means of a second mass M, a second spring constant K and a second damping factor D; wherein the second oscillation frequency is proportional to $\sqrt{(K/M)}$; and wherein the second damping is proportional to $D/(2*\sqrt{(M*K)})$.

12. The method according to claim 1, wherein a first transfer function in the Laplace domain of the first damped harmonic oscillator, which links the first motion profile to the oscillations is: $G(s)=(b*s+1)/(a*s^2+b*s+1)$; with a corresponding to the first parameter and b corresponding to the second parameter;

wherein a second transfer function in the Laplace domain of the second damped harmonic oscillator, which links the second motion profile to the oscillations is: $G(s)=(b'*s'+1)/(a'*s'^2+b'*s'+1)$;

with a' corresponding to the third parameter and b' corresponding to the fourth parameter.

13. The method according to claim 1, wherein during the modifying of the first initial motion profile and the second initial motion profile, the first initial motion profile is filtered with a first transfer function expressed in the Laplace domain being proportional to $(a*s^2+b*s+1)$ for determining the first motion profile, with a corresponding to the first parameter and b corresponding to the second parameter; and wherein during the modifying of the first initial motion profile and the second initial motion profile, the second initial motion profile is filtered with a second transfer function expressed in the Laplace domain being proportional to $(a'*s'^2+b'*s'+1)$ for determining the second motion profile, with a' corresponding to the third parameter and b' corresponding to the fourth parameter.

14. The method according to claim 1, wherein during the modifying of the first initial motion profile and the second initial motion profile, a first optimization sub-step is executed, during which the first motion profile which generates the oscillations when considering a first transfer function in the Laplace domain which is proportional to $((b*s+1)/(a*s^2+b*s+1))$ is determined;

with a corresponding to the first parameter and b corresponding to the second parameter; and wherein during the modifying of the first initial motion profile and the second initial motion profile, a second optimization sub-step is executed, during which the second motion profile which generates the oscillations when considering a second transfer function in the Laplace domain which is proportional to $((b'*s'+1)/(a'*s'^2+b'*s'+1))$ is determined;

with a' corresponding to the third parameter and b' corresponding to the fourth parameter.

15. The method according to claim 14, wherein during the optimization sub-step, at the beginning of the optimization sub-step itself one applies a first motion profile obtained from a filtering of the first initial motion profile considering a first transfer function expressed in the Laplace domain being proportional to $(a*s^2+b*s+1)$, with a corresponding to the first parameter and b corresponding to the second parameter; and wherein during the optimization sub-step, at the beginning of the optimization sub-step itself one applies a second motion profile obtained from a filtering of the second initial motion profile considering a second transfer function expressed in the Laplace domain being proportional to $(a'*s'^2+b'*s'+1)$, with a' corresponding to the third parameter and b' corresponding to the fourth parameter.

16. The method according to claim 1, wherein the metallic article is an elongated metallic article chosen from the group consisting of a metal wire and a metal tube.

17. A bending machine for bending a metallic article, comprising:

a control unit configured to control the operation of the bending machine itself;

a bending head having at least one bending group configured to bend the metallic article; and an activation apparatus configured to activate a relative movement between the bending head and the metallic article;

wherein the bending group comprises at least a first actuation device configured to actuate the at least one bending group according to a respective first motion profile for executing a respective bending of the metallic article;

wherein the activation apparatus comprises at least a second actuation device configured to actuate the relative movement between the bending head and the metallic article according to a respective second motion profile;

wherein the bending machine is configured to execute a step of modifying, prior to an actuation of the at least one bending group by the first actuation device and an actuation of the relative movement by the second actuation device, a first initial motion profile of the first actuation device to obtain the respective first motion profile to be used during the actuation of the at least one bending group and a second initial motion profile of the second actuation device to obtain the respective second motion profile to be used during the actuation of the relative movement;

wherein the bending machine is configured to modify the first initial motion profile in function of a first parameter and of a second parameter and to modify the second initial motion profile in function of a third parameter and a fourth parameter;

wherein the first parameter depends on a first oscillation frequency of a first damped harmonic oscillator which models the oscillations of the metallic article resulting from the application of the respective motion profile of the respective first actuation device and the second parameter depends on a damping of the oscillations of the damped harmonic oscillator;

wherein the third parameter depends on a second oscillation frequency of a second damped harmonic oscillator which models the oscillations of the metallic article resulting from the application of the respective second motion profile of the respective second actuation device and the fourth parameter depends on a second damping of the oscillations of the second damped harmonic oscillator.

18. The bending machine according to claim 17, wherein the metallic article is an elongated metallic article chosen from the group consisting of a metal wire and a metal tube.

* * * * *